United States Patent [19]

Volker

[11] 4,179,246

[45] Dec. 18, 1979

[54] CRANKCASE VENT APPARATUS AND METHOD

[75] Inventor: James W. Volker, Cincinnati, Ohio

[73] Assignee: The Scott & Fetzer Company, Lakewood, Ohio

[21] Appl. No.: 871,780

[22] Filed: Jan. 24, 1978

[51] Int. Cl.[2] ..... F04B 21/00

[52] U.S. Cl. ..... 417/313; 55/522; 55/DIG. 13; 55/DIG. 19; 123/41.86

[58] Field of Search ..... 417/313; 123/41.86, 123/41.65; 55/514, 466, 522, DIG. 19, DIG. 13

[56] References Cited

U.S. PATENT DOCUMENTS

| | | | |
|---|---|---|---|
| 911,540 | 2/1909 | Guilford | 123/41.65 |
| 1,432,187 | 10/1922 | Jenkins et al. | 55/DIG. 19 |
| 1,921,175 | 8/1933 | Towler | 123/41.86 |
| 2,187,264 | 1/1940 | Carlson | 55/DIG. 19 |
| 2,500,567 | 3/1950 | Phillips | 123/41.86 |
| 2,500,859 | 3/1950 | Pates | 123/41.86 X |
| 2,707,460 | 5/1955 | Horn | 123/41.86 |
| 3,308,610 | 3/1967 | Springer et al. | 55/DIG. 13 |
| 3,363,616 | 1/1968 | Baumgarten | 123/41.86 X |
| 3,844,688 | 10/1974 | Bulkley et al. | 417/313 |

*Primary Examiner*—Carlton R. Croyle
*Assistant Examiner*—Edward Look
*Attorney, Agent, or Firm*—Wood, Herron & Evans

[57] ABSTRACT

A crankcase vent apparatus comprises a stack having a lower end adapted for connection to a crankcase vent and an upper end having a filter therein and presenting an irregular opening to an air flow across the stack.

27 Claims, 6 Drawing Figures

CRANKCASE VENT APPARATUS AND METHOD

This invention relates to apparatus and methods for venting crankcases and more particularly to vent stacks and methods for venting crankcases, such as those of compressors, where the vent is located within an air flow. While this invention is useful in venting crankcases or other housings in general, it is particularly useful in venting an air compressor crankcase where the vent is located in an air flow thereacross.

An air compressor typically includes an upper casing and head for housing the compressor's pistons, and a lower crankcase casing housing the crankshaft and lower piston apparatus, together with appropriate lubricant. The crankshaft extends through a bearing outwardly of the crankcase and a crankcase vent is typically located above this bearing, sometimes in a boss extending outwardly from the crankcase.

A pulley is mounted on the outer end of the crankshaft. In order to cool the compressor casing, the pulley spokes are disposed in the shape of fan vanes, operable to blow air over the compressor casing when the pulley is driven by a belt and motor to operate the compressor.

From this description, it will be appreciated that the vent is normally disposed between the pulley and the major portion of the compressor casing. In any case, the vent is typically located within the air flow generated by the pulley vanes. During the operation of such a compressor, droplets of lubricant tend to exhaust through the vent and are blown over the compressor and its components causing a general mess.

The actual cause of such leakage is not positively known, but it is believed the cause varies from compressor to compressor depending on factors such as the positive pressure generated in the crankcase by the pistons or by leakage around the piston rings, the agitation action generated in the lubricant, the nature of the vent passageway in the crankcase to the vent opening, and the air flow over the vent. While prior breather stacks and baffles have tended in some cases to slow down the onset of this leaking, none known to applicant prior to this invention have proved entirely satisfactory since all have been found to eventually leak.

Accordingly, it has been one objective of this invention to provide improved apparatus and methods for venting a crankcase.

A further objective of the invention has been to provide improved crankcase venting apparatus and methods for venting a crankcase via a vent located within an air flow.

A further objective of the invention has been to provide improved apparatus and methods for venting a crankcase and for inhibiting the leaking or escape of lubricant therefrom.

To these ends, a preferred embodiment of the invention comprises a cylindrical vent stack having a small diameter lower end, adapted for operable communication with a compressor crankcase vent typically located within an air flow during compressor operation, and a larger diameter upper end having edges defining a vent opening. At least a portion of the edges define an opening in a plane which intersects the general direction of the air flow and is at an angle other than 90° with respect to the longitudinal axis of the stack. Another portion of the opening, defined by opposed edges, lies in a plane normal to the longitudinal axis and parallel to the direction of the air flow. Still another portion of the opening lies in another plane also angled with respect to the longitudinal axis of the stack, and to the air flow direction. Thus, the stack provides an irregular vent opening, a portion of which intersects the direction of the air flow, formed by cutting off portions of the open end of the stack at an angle other than 90° with respect to the stack's longitudinal axis. The stack is situated in the vent so that opposite edge portions, which are in a plane normal to the longitudinal axis, lie across the air flow, and at least one of the angled openings opens toward the source of the air flow.

A filter is located in the stack's upper end and preferably comprises a foamed urethane filter having about 20 pores per square inch, although certain other filters may be used.

Applicant has found this invention provides crankcase venting without lubricant leakage or exhaust, thereby eliminating undesirable coating of the outside surfaces of the crankcase or other compressor parts with stray lubricant.

These and other objects and advantages will become readily apparent from the following detailed description of a preferred embodiment of the invention and from the drawings in which.

Figure 1:
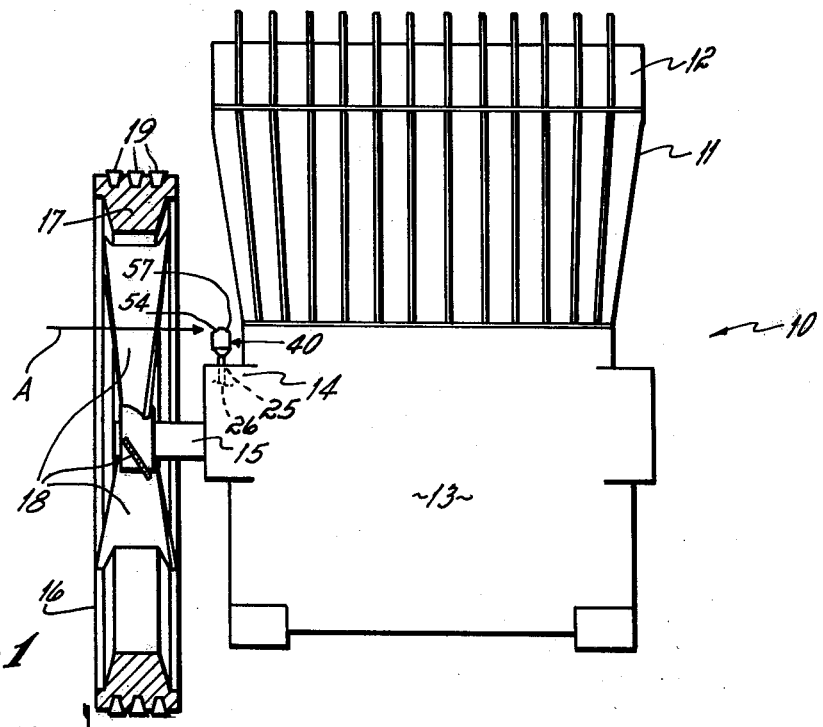
FIG. 1 is a front view of a compressor fitted with a vent stack according to the invention.

Turning now to the drawings, there is shown in FIG. 1 thereof a compressor 10 which includes an upper finned casing 11 and head 12, which houses the compressor pistons (not shown), and a lower crankcase casing 13 housing the lower end of the compressor's piston apparatus, together with an appropriate lubricant. The crankcase 13 is provided with a boss 14 in which is located a bearing through which crankshaft 15 extends. A pulley or flywheel 16 is mounted on the crankshaft 15 and comprises an outer rim mounted 17 on or supported by fan-shaped spokes 18. Appropriate V-belts 19 are shown in cross section about the pulley and are adapted to be connected to a driving motor (not shown) for rotating the pulley to drive the crankshaft 15 and thereby the compressor pistons which are connected thereto within the crankcase 13. As the pulley is turned, the fan-shaped spokes 18 are operable to blow air over the compressor in the direction of air flow arrow A in order to cool the compressor.

Figure 2:
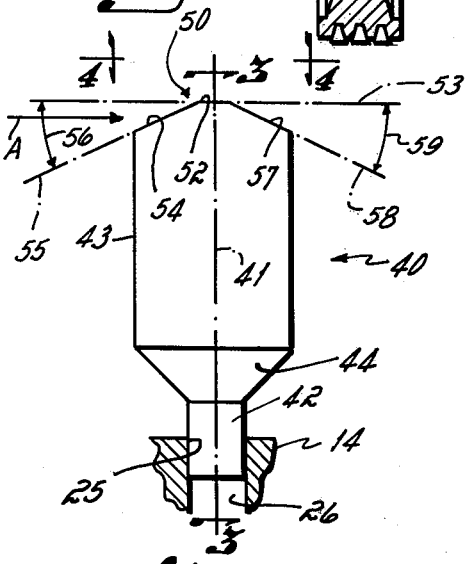
FIG. 2 is an elevational view of the vent stack of the invention shown in FIG. 1.

The lower crankcase 13 is provided with a vent 25 located in a portion of the boss 14 as best seen in FIGS. 1 and 2. The vent 25 communicates with the interior of the crankcase via passageway 26 for venting the crankcase to the atmosphere.

Figure 3:
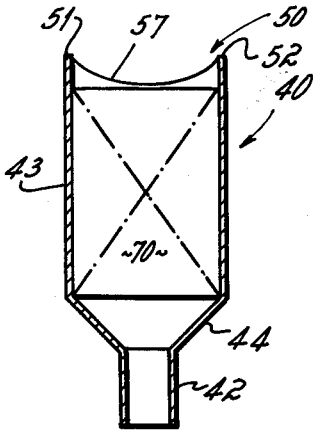
FIG. 3 is a cross-sectional view taken along lines 3—3 of FIG. 2.
Figure 4:
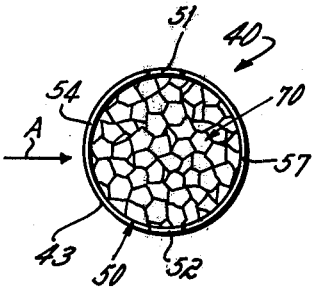
FIG. 4 is a top plan view taken along lines 4—4 of FIG. 2.

The vent stack 40 of the present invention is best seen in FIGS. 2 through 4. The stack 40 comprises a generally cylindrical stack member, having a longitudinal axis 41. It further includes a lower end 42, of reduced diameter, and an upper end 43 of larger diameter, the upper end tapering into the lower end via a funnel portion 44. The stack is opened at both its lower and its upper ends and, when in operative communication with the vent 25, forms a passageway through which the crankcase is vented to the atmosphere through an opening 50 at the upper end of the stack.

The opening 50 is defined by edge portions of the upper end 43 of the stack. First edge portions 51 and 52 are disposed on opposite sides of the stack and lie in a plane 53 which is normal to the longitudinal axis 41 of the stack. As will be appreciated, plane 53 is also parallel to the direction of the air flow indicated by the arrow A.

The opening 50 is further defined, in part, by a second edge portion 54 which extends from each of the respective first edge portions 51 and 52 and which lies in a plane 55 which is disposed at an angle 56, which is approximately 30° with respect to the normal 53 of the longitudinal axis 41. A third edge portion 57 defines the remainder of the opening 50 and somewhat similarly to the edge portion 54 lies in a different plane 58, formed at an angle 59 of about 30° with respect to the normal 53 to the longitudinal axis 41.

It will further be appreciated that each of the planes 55 and 58 intersect the general direction of the air flow indicated by the arrow A. Also, it should be noted that the opening defined by the edge portion 54 faces upstream with respect to the air flow or, in other words, toward the source of the air flow, and thus in use is mounted as shown in FIG. 1. Thus, the edge portions 51, 52, 54 and 57 form an irregular opening for the vent stack within the air flow generated by the pulley 16.

A filter 70 is disposed within the upper end 43 of the vent stack 40 as shown in FIGS. 3 and 4. Filter 70 comprises a foamed urethane filter, having a porosity of approximately 20 pores per square inch, in a generally cylindrical shape conforming to that of the top portion 43 of the stack 40. One specific foamed urethane filter which has been found particularly useful in connection with this invention is purchased from Cincinnati Gasket Packing & Mfg., Inc., Cincinnati, Ohio, under the trade designation "E.I.20-20 ppi Charcoal Scott Polyurethane". The outside diameter of the circular filter plug 70 is slightly larger than the inside diameter of the vent stack 40 such that the filter engages the stack all around the sides thereof.

Figure 5:
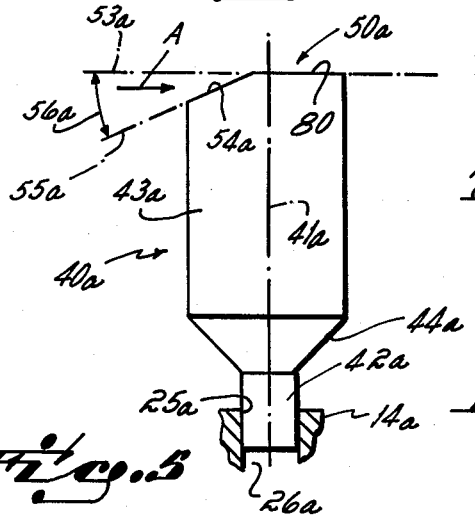
FIG. 5 and 6 are elevational and plan views respectively of an alternate embodiment of the invention.
Figure 6:
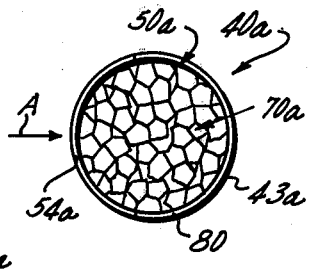

FIGS. 5 and 6 illustrate an alternate embodiment of the invention and have similar parts to the preferred embodiment designated by the suffix "a" following the identification numbers. The stack **40*a* of FIG. 5 is similar to the stack 40 of the preferred embodiment with the exception that the opening in the upper end of the stack lies in only 2 planes 55*a* and 53*a*, the opposite side of the stack not being relieved to form the tapered edge portions 57 of the preferred embodiment. Rather, the opening in the stack 40*a* is formed by an edge portion 80 lying in the plane 53*a* which is normal to the longitudinal axis 41*a* of the stack 40*a*. The opening is further defined by edge portions 54*a* extending from the edge portion 80 and lying in a plane 55*a* which is disposed at an angle 56*a* (of about 30°) with respect to the normal 53*a* to the longitudinal axis 41*a*. In use, the stack 40*a* is inserted into a vent 25*a* with the same orientation as the stack 40, the opening defined by edge 54*a* facing the upstream direction of the air flow, i.e., that is to say toward the pulley 16. A filter 70*a*, as in the preferred embodiment, is disposed within the stack 40*a***.

Applicant has discovered that the stacks disclosed herein are very effective in eliminating the undesirable leakage or dispersal of any lubricant through the vent 25, even during long periods of compressor operation, and despite the air flow across the vent 25 and across the stack opening 50. It should be noted, however, that if the filter 70 is removed from the stack, the leakage resisting capabilities of the vent stack 40 are reduced and lubricant may escape. Accordingly, applicant has found that when a filter of the specific type disclosed herein is utilized, the leakage or exhaustion of lubricant is eliminated, even during long compressor operation. While filters of porosities varying from that described herein may be found useful in connection with stacks according to the invention herein, the filter described is particularly useful and a filter of some form is believed to be critical to effective operation of the invention.

These and other advantages and modifications will become readily apparent to those of ordinary skill in the art without departing from the scope of this invention. For example, filters of porosities varying in some degree may be found to be useful; the exact porosity ranges for effective operation not yet having been discovered. Also, other irregular openings with respect to the air flow may also be found to be useful. Accordingly, applicant intends to be bound only by the claims appended hereto.

I claim:

1. Stack apparatus for cooperating with a crankcase vent within an air flow and through which lubricant normally escapes, said stack apparatus for inhibiting lubricant escape and including:

a vent stack having one open end operably connected to said vent and a second open end within said air flow;

a filter within said stack;

said stack having a longitudinal axis substantially perpendicular to said air flow and at least a portion of said second open end being in a plane which intersects said longitudinal axis at an angle other than 90° and being upstream in said air flow of other portions of said second open end which are in a plane intersecting said axis at about 90°.

2. A crankcase vent stack of substantially cylindrical shape, and having a longitudinal axis, said stack including:

a passageway therethrough for venting a crankcase;

a lower open end adapted for operable connection to a crankcase vent, and an upper end having a filter therein and providing an irregular opening for said passageway, said irregular opening defined by at least two edge portions of said upper end, the first of which lie in a plane which intersects said longitudinal axis at an angle of about 90°, and the other of which lie in a plane which intersects said axis at an angle of other than 90°.

3. A vent stack as in claim 2 wherein said edges of said upper end include two first portions on opposite sides of said cylindrical stack and in a plane normal to said longitudinal axis, and second edge portions, on one side of said stack, lying in said plane intersecting said axis at an angle of other than 90° and extending from each of said first portions.

4. A vent stack as in claim 3 wherein said angle other than 90° is about 30° from the normal to said axis.

5. A vent stack as in claim 3 including a third edge portion extending from said first portions on another side of said stack and lying in another plane intersecting said longitudinal axis at a second angle of other than 90°.

6. A vent stack as in claim 5 wherein said second angle is about 30° from the normal to said axis.

7. A vent stack as in claim 3 wherein said stack is connected to a crankcase vent and is disposed in an air flow, said two first portions on opposite sides of said stack being disposed across said air flow.

8. A vent stack as in claim 3 wherein the lower end of said stack is of less diameter than said upper end, said upper end tapering into said lower end.

9. A vent stack as in claim 2 wherein said filter has a porosity of about 20 pores per square inch.

10. A vent stack as in claim 2 wherein said filter is a foamed urethane filter having a porosity of about 20 pores per square inch.

11. A crankcase vent stack for venting a compressor crankcase, during compressor operation, at a location within an air flow, said stack being of substantially cylindrical shape and having a longitudinal axis, said stack having a passageway therethrough for venting said crankcase and further including:

a lower end adapted for operable connection to a crankcase vent;

an upper end of larger diameter than said lower end and tapering into said lower end;

a filter in said upper end;

said upper end having an opening defined by edges of said stack;

first edge portions on opposite sides of said stack lying in a plane normal to said longitudinal axis, and disposed across said air flow when said stack is connected to a crankcase vent during compressor operation; and a second edge portion on one side of said stack extending from each of said first edge portions and lying in a plane intersecting said longitudinal axis at a first angle other than 90°, said second edge portion being upstream in said air flow from said first edge portions when said stack is connected to a crankcase vent during compressor operation.

12. A stack as in claim 11 wherein said first angle is about 30° from normal to said longitudinal axis.

13. A stack as in claim 12 wherein said filter has a porosity of about 20 pores per square inch.

14. A vent stack as in claim 11 including a third edge portion extending from each of said first edge portions on another side of said stack and lying in another plane intersecting said longitudinal axis at a second angle other than 90°.

15. A vent stack as in claim 14 wherein said second angle is about 30° from normal to said longitudinal axis.

16. A vent stack as in claim 15 wherein said filter has a porosity of about 20 pores per square inch.

17. A method of venting a crankcase including the steps of:

venting said crankcase through a stack means operably communicating with said crankcase and having a filter therein;

creating an air flow across said stack means;

disposing a stack vent opening of said stack means within said air flow with at least a portion of said opening lying in a plane intersecting the direction of said air flow at an angle, and another downstream portion of said opening being in a plane parallel to the direction of said air flow.

18. In a compressor of the type having at least one cylinder, a lubricant containing crankcase, a crankcase vent opening, and a drive pulley mounted on a shaft extending from said crankcase, said pulley having spokes disposed for creating an air flow toward said cylinder and crankcase and over said vent opening when driven to operate said compressor, crankcase vent stack apparatus for exhausting said crankcase and comprising a vent stack having a first open end adapted for fitting in said vent opening and a second open end, disposed within said air flow when said pulley is driven, said second open end being defined by first and second stack end edges, said first stack end edges residing in a plane parallel to the direction of said air flow, and said second stack end edges residing in another plane intersecting the direction of said air flow, and a filter means in said stack.

19. Vent stack apparatus as in claim 18 wherein said second stack end edges reside in a plane intersecting that in which said first stack end edges lie.

20. Vent stack apparatus as in claim 18 wherein said vent stack is an integral one-piece component.

21. Vent stack apparatus as in claim 18 wherein said vent stack is of curved cross section throughout its extension.

22. Vent stack apparatus as in claim 18 wherein said vent opening is located in said crankcase between said pulley and said cylinder.

23. Vent stack apparatus as in claim 18 wherein said vent stack has a longitudinal axis and wherein said first stack end edges reside in a plane which is parallel to the direction of said air flow and which intersects said longitudinal axis at about 90°, and wherein said second stack end edges reside in a plane which intersects both the direction of said air flow and said longitudinal axis.

24. Vent stack apparatus as in claim 18 wherein said filter means comprises a porous filter having a porosity of about 20 pores per square inch.

25. Vent stack apparatus as in claim 18 wherein said vent stack has a vertical longitudinal axis when said first open end is fitted in said vent opening and wherein said plane parallel to said air flow direction intersects said longitudinal axis at about 90° while said other plane intersects both said air flow and said longitudinal axis.

26. Vent stack apparatus as in claim 18 further including third vent stack edges residing in a third plane which intersects the direction of said air flow.

27. In a compressor of the type having at least one cylinder, a lubricant containing crankcase, a crankcase vent opening, and a drive pulley mounted on a shaft extending from said crankcase, said pulley having spokes disposed for creating an air flow toward said cylinder and crankcase and over said vent opening when driven to operate said compressor, crankcase vent stack apparatus for exhausting said crankcase and comprising a vent stack having a first open end adapted for fitting in said vent opening, a second open end, disposed within said air flow when said pulley is driven, a filter in said stack between said ends and a longitudinal axis, said second open end being defined by first, second and third stack end edges, said first stack end edges comprising two edge portions on opposite sides of said stack and lying in a plane parallel to the direction of said air flow, and normal to said axis, said second stack end edges lying in a second plane intersecting said direction of air flow at one angle and said axis at an angle of other than 90°, and said third stack end edges lying in a third and different plane intersecting said direction of air flow at one angle and said axis at an angle of other than 90°, said first, second and third edges being connected to form an irregular opening.

* * * * *